US006135559A

United States Patent [19]

Kowalski

[11] Patent Number: 6,135,559

[45] Date of Patent: Oct. 24, 2000

[54] SEAT BACK RECLINING MECHANISM ADAPTABLE TO CHAIRS WITH STATIONARY OR MOVABLE SEATS

[75] Inventor: Jerome R. Kowalski, Hickory, N.C.

[73] Assignee: Hickory Springs Manufacturing Co., Hickory, N.C.

[21] Appl. No.: 09/123,192

[22] Filed: Jul. 27, 1998

Related U.S. Application Data

[60] Provisional application No. 60/054,053, Jul. 31, 1997.

[51] Int. Cl.[7] ..... A47C 1/032

[52] U.S. Cl. ..... 297/354.12; 297/68; 297/301.5

[58] Field of Search ..... 297/301.5, 302.5, 297/83, 68, 89, 354.12, 69

[56] References Cited

U.S. PATENT DOCUMENTS

| | | | |
|---|---|---|---|
| 67,165 | 7/1867 | Childs | 297/354.12 |
| 2,740,131 | 4/1956 | Vogel et al. . | |
| 2,978,013 | 4/1961 | McIntyre | 297/354.12 |
| 3,083,996 | 4/1963 | Caldemeyer et al. . | |
| 3,096,118 | 7/1963 | Dubeck . | |
| 3,104,128 | 9/1963 | Schliephacke | 297/354.12 X |
| 3,166,353 | 1/1965 | Re | 297/83 X |
| 3,371,959 | 3/1968 | Gordin . | |
| 3,429,612 | 2/1969 | Cobb . | |
| 3,494,660 | 2/1970 | Caldemeyer et al. . | |
| 3,781,060 | 12/1973 | Pentlien . | |
| 4,190,282 | 2/1980 | Crawford . | |
| 4,226,473 | 10/1980 | Johnson | 297/68 X |
| 4,244,620 | 1/1981 | Harrison et al. | 297/89 X |
| 4,350,387 | 9/1982 | Rogers, Jr. | 297/85 |
| 4,570,996 | 2/1986 | Rogers, Jr. . | |
| 4,660,883 | 4/1987 | Kowalski . | |
| 5,064,244 | 11/1991 | Sproule | 297/68 |
| 5,263,768 | 11/1993 | Scheulderman | 297/354.12 X |

FOREIGN PATENT DOCUMENTS

| | | | |
|---|---|---|---|
| 2482857 | 11/1981 | France | 297/68 |
| 2547183 | 12/1984 | France | 297/354.12 |
| 2454190 | 5/1975 | Germany | 297/354.12 |

*Primary Examiner*—Peter M. Cuomo
*Assistant Examiner*—David E. Allred
*Attorney, Agent, or Firm*—Kennedy Covington Lodbell & Hickman, LLP

[57] ABSTRACT

A seat back reclining mechanism for use in recliner and non-reclining chairs for selective movement of the seat back portion relative to and independently of the seat portion between a sitting position of the seat back portion and a reclined position of the seat back portion.

20 Claims, 7 Drawing Sheets

SEAT BACK RECLINING MECHANISM ADAPTABLE TO CHAIRS WITH STATIONARY OR MOVABLE SEATS

CROSS-REFERENCE TO RELATED APPLICATION

This disclosure incorporates and has the priority of U.S. Provisional Patent Application Serial No. 60/054,053, filed Jul. 31, 1997, entitled SEAT BACK RECLINING MECHANISM ADAPTED TO CHAIRS WITH STATIONARY OR MOVABLE SEATS.

BACKGROUND OF THE INVENTION

The present invention relates broadly to furniture designed to support a user's body in an essentially seated disposition, including traditional chairs (both of the type having a stationary seat portion and the type having a movable seat portion such as chairs conventionally referred to as recliners or incliners), chair sections of sofas, love seats and the like, sofa beds, and any other article of furniture having an essentially horizontal seat portion and an angularly oriented seat back portion, all of which are generically referred to herein as "chairs." More particularly, the present invention relates to a novel mechanism by which the seat back portion of any such chair may be selectively reclined angularly relative to the seat portion independently of and without regard to any movement or non-movement of the seat portion.

Recliner-type chairs are well known and the mechanical arrangements used therein for accomplishing the reclining motion are diverse and varied. Representative examples of varying types of recliner chairs are disclosed in U.S. Pat. Nos. 3,874,724; 3,941,417; 3,958,827; 4,071,275; 4,077,663; 4,099,776; 4,108,491; 4,153,292; 4,195,878; 4,202,580; 4,350,386; 4,350,387; and 4,531,778.

Currently, the more popular types of recliner chairs typically provide three basic positions, a normal non-reclined sitting position with the seat generally horizontal and the seat back substantially upright, a partially reclined position often referred to as a "TV" position wherein the seat and seat back are disposed in a slightly reclined disposition but with the seat back still sufficiently upright to permit comfortable television viewing from the chair, and a fully reclined position wherein the seat back is pivoted toward horizontal into an obtuse relationship with the seat for lounging or sleeping. Most such recliner chairs also include a footrest coordinated with the mechanical arrangement to be extended forwardly of the seat in the TV and fully reclined positions.

Such recliner chairs have met with substantial popularity. However, the recliner mechanisms utilized in such chairs are relatively complicated, which adds significantly to the overall cost of a recliner chair in comparison to comparable chairs without any reclining capability. Essentially, a potential segment of the chair market has been left largely unaddressed in that few if any chairs have been introduced providing a more simplified and less expensive capability for merely reclining the seat back without incorporating the multiple positions and/or movable foot rest of traditional reclining chairs of the type described above. Further, many traditional reclining chairs suffer the disadvantage that the seat back in the fully reclined position will contact an adjacent wall unless the base of the chair is moved outwardly away from the wall. To address this problem, various recliner mechanisms have been designed to cause the seat and seat back to move forwardly relative to the chair base while moving from the TV position to the fully reclined position, thereby to avoid contact between the seat back and the wall.

SUMMARY OF THE INVENTION

Fundamentally, the present invention seeks to provide a simplified mechanism which can be adapted to essentially any type of chair to permit the seat back of the chair to be selectively reclined relative to the seat independently of and without regard to any movability of the seat. Hence, the seat back reclining mechanism of the present invention may be adapted to traditional chairs which heretofore have not incorporated any reclining mechanism, without necessitating usage of the relatively complicated and more expensive mechanical arrangement used in traditional recliners to move the seat and foot rest portions. Further, the reclining mechanism of the present invention is equally adaptable to traditional recliner chair mechanisms, including those of the wall-avoiding type, to permit not only movement of the seat back between a TV position and fully reclined position, but also to permit reclining of the seat back relative to the seat even in the normal non-reclined sitting position without the necessity of manipulating the chair into the TV or fully reclined positions. As indicated above, the invention will thus be particularly adaptable to other types of chairs (as broadly defined herein), including chair sections of sofas, love seats and the like, and even the back rest portions of sofa beds and the like. By way of example but without limitation, the invention is illustrated and described hereinafter in one contemplated embodiment of the present recliner mechanism in a representative conventional recliner-type chair, but it will be appreciated by persons skilled in the art and it is to be understood that the present invention may be equally well adapted to be incorporated and embodied into essentially any other type of "chair" as herein defined.

Briefly summarized, the seat back reclining mechanism of the present invention is incorporated into a chair having an essentially horizontal seat portion and an angularly oriented seat back portion and is selectively actuable to move the seat back portion relative to and independently of the seat portion between a sitting position of the seat back portion and a reclined position of the seat back portion. The seat back reclining mechanism of the present invention will have these basic characteristics whether incorporated into a recliner chair or into a non-reclining chair. In a preferred embodiment in a recliner chair having a linkage structure on which the seat portion and the seat back portion are affixed for actuation and control of relative movements thereof between the aforementioned sitting and reclining positions, the seat back reclining mechanism is preferably affixed movably to the linkage structure for permitting reclining of the seat back portion independently of the movement and disposition of the linkage structure.

The preferred form of seat back reclining mechanism in accordance with the present invention provides a mounting element supported either from the chair frame or, in the case of recliner chairs, from the linkage structure, with at least one (preferably two) recliner links pivotably affixed to the mounting element and to a bracket affixed to the seat back portion. A spring or other biasing element preferably extends between one such link and the mounting element to urge the seat back portion into its upright disposition, thereby assisting in return movement from a reclined position into a sitting position.

DETAILED DESCRIPTION OF THE PREFERRED EMBODIMENT

Figure 1:
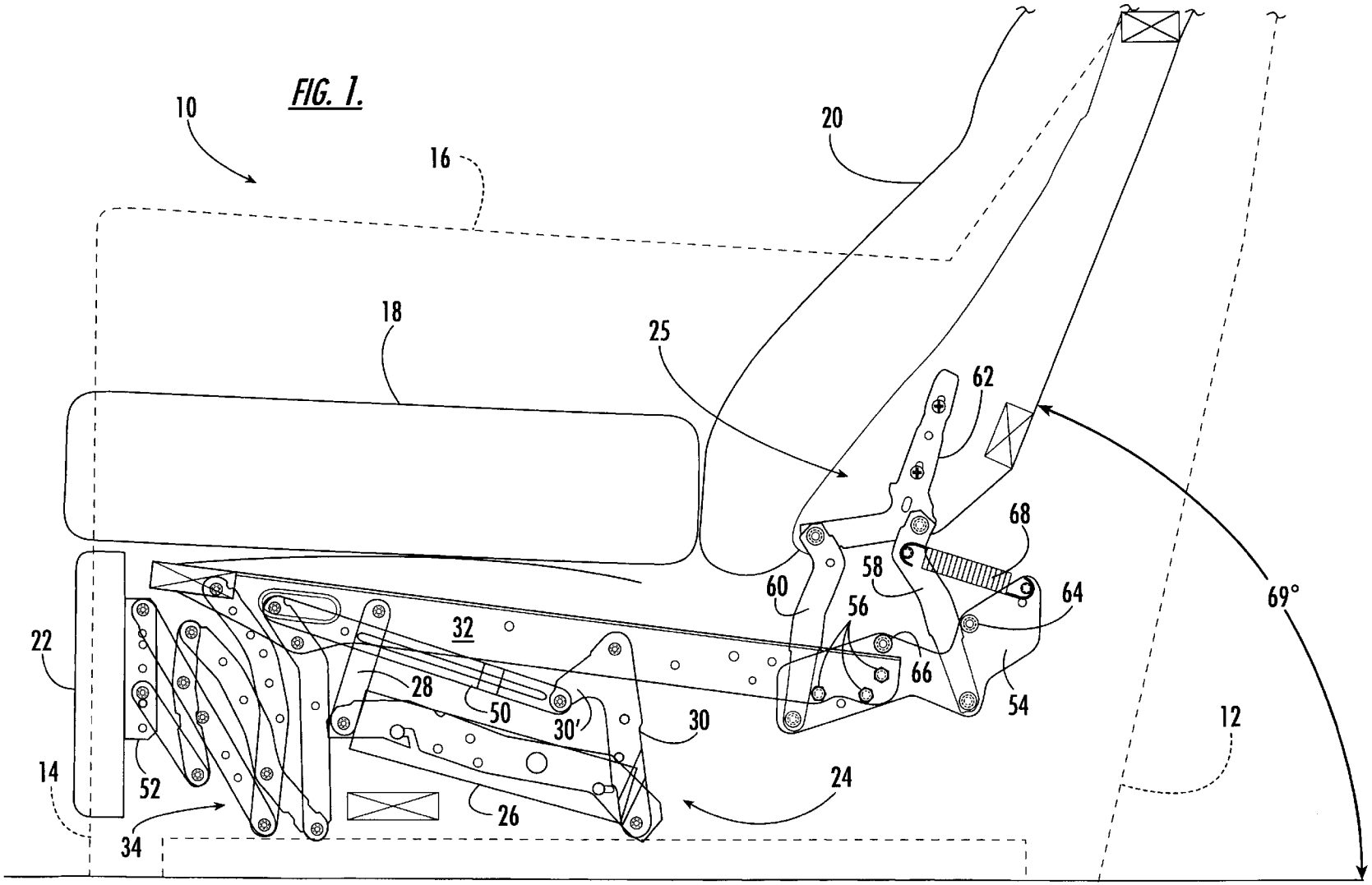
FIGS. 1–4 are side elevational views of a recliner chair in which is mounted the preferred embodiment of the reclining mechanism of the present invention in conjunction with a representative form of conventional recliner linkage structure, illustrating the linkage structure and the recliner mechanism in four possible positions: (a) a full upright sitting position shown in FIG. 1, (b) a partially reclined "TV" position shown in FIG. 2, (c) a fully extended reclining position shown in FIG. 3, and (d) a modified upright sitting position with the seat disposed as in FIG. 1 but with the seat back reclined relative thereto as shown in FIG. 4, the frame and cushions of the recliner chair being shown schematically for clarity of illustration.

Referring now to the accompanying drawings, a recliner chair is generally indicated at 10, basically including an upholstered chair framework 12 having a stationary floor-standing base 14 with laterally spaced arm rests 16 between which a seat 18, a seat back 20 and a foot rest 22 are movably supported on the base 14 by a linkage structure 24 and by the auxiliary recliner mechanism 25 arranged to articulably actuate and control movement of the seat 18, seat back 20 and foot rest 22 between the aforementioned positions of FIGS. 1–4, as more fully described hereinbelow.

The linkage structure 24 basically comprises two essentially mirror-image linkage assemblies respectively mounted in opposed facing relation to the spaced arm rests 16 of the base 14 with the seat 18, the seat back 20 and the foot rest 22 each being affixed to and extending between the two linkage assemblies, whereby the linkage assemblies execute simultaneous identical movements between the full upright, TV, reclined and upright-reclined positions of FIGS. 1–4 respectively. As the components of the two linkage assemblies are identical at each side of the base 14, only one linkage assembly at one side of the base 14 is illustrated in the accompanying drawings at 24 and described herein.

With more detailed reference to FIGS. 1–4, each linkage assembly of the linkage structure 24 comprises a main mounting plate 26 rigidly bolted in a generally horizontal disposition interiorly to the associated arm rest 16 of the base 14. A front support link 28 is pivoted at its lower end to, and extends upwardly from, the forward end of the mounting plate 26 and, similarly, a rear support link 30 is pivoted at its lower end to, and extends upwardly from, the rearward end of the mounting plate 26 in spaced relation to the front support link 28. The respective upper ends of the front and rear support links 28,30 are pivoted to a seat mounting rail 32 at spacings longitudinally therealong to support the rail 32 for forward and rearward translatory motion relative to the mounting plate 26. A lazy tong-type linkage assembly 34 comprised of a pair of drive links 36,38 pivotably interconnected with support links 40,42,44,46 is mounted at the forward end of the seat mounting rail 32 by pivotal attachment of the drive link 36 directly to the forward end of the seat mounting rail 32 and pivotal attachment of the drive link 38 within a slot 48 in the seat mounting rail. In turn, the drive link 38 is pivoted within the slot 48 to the forward end of an actuating link 50 whose rearward end is pivoted to a downwardly projecting crank arm portion 30 of the rear support link 30. The foot rest 22 is supported at the outward free end of the lazy tong linkage assembly 34 by a support bracket 52 pivoted to the support links 40,46.

Figure 5:
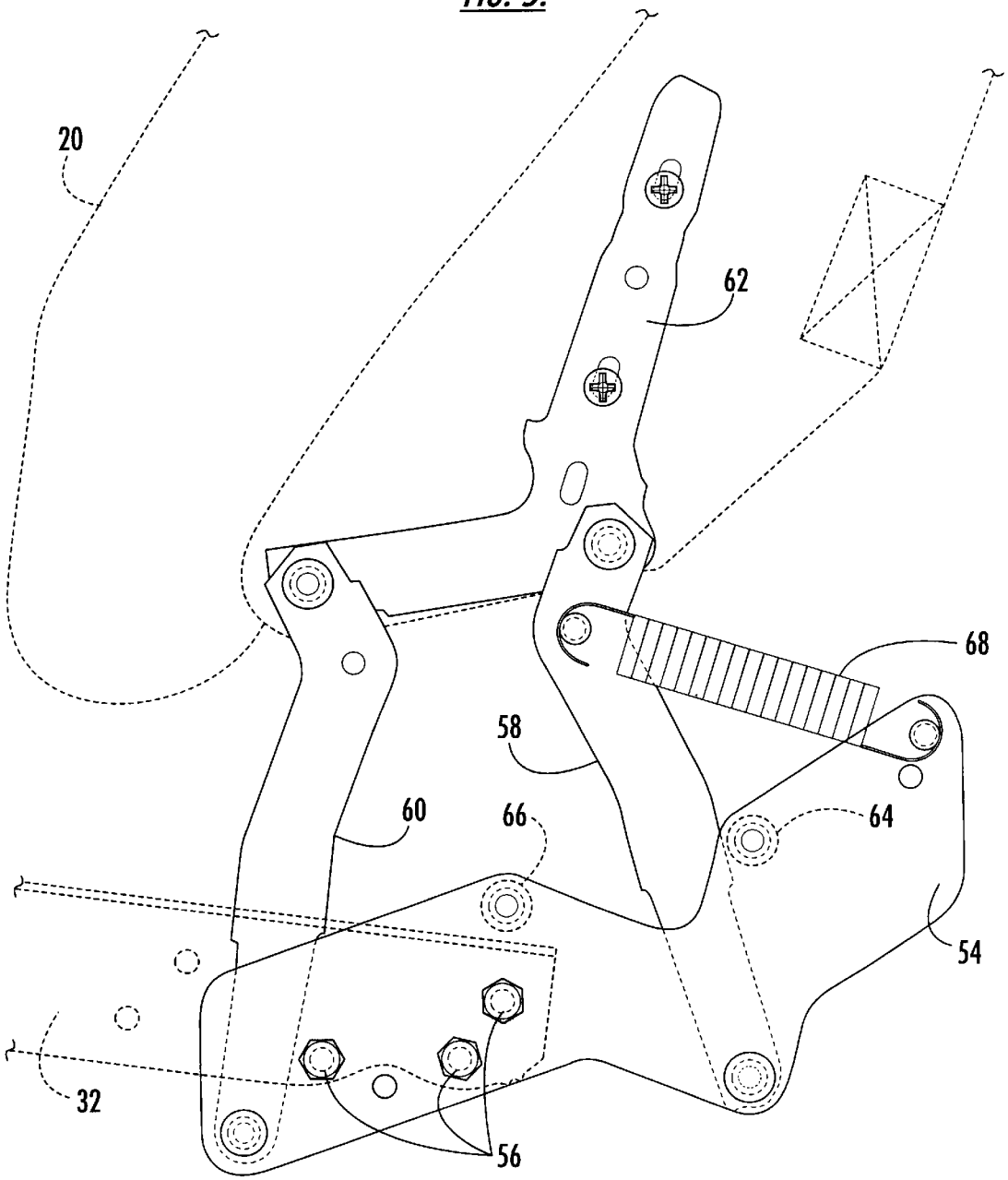
FIGS. 5–7 are enlarged side elevational views of the recliner mechanism showing in greater detail the disposition thereof in FIGS. 1–3, respectively.
Figure 6:
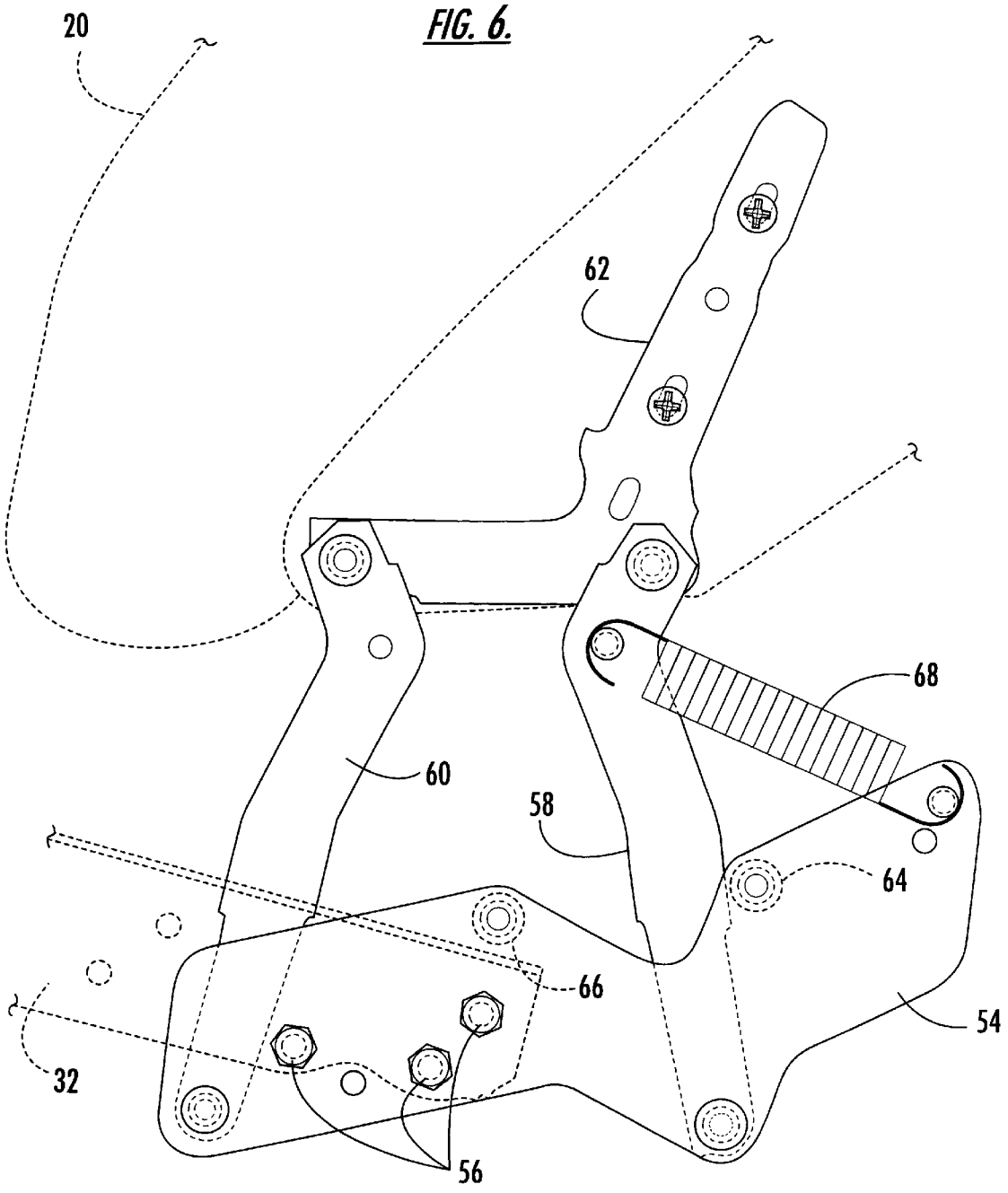
Figure 7:
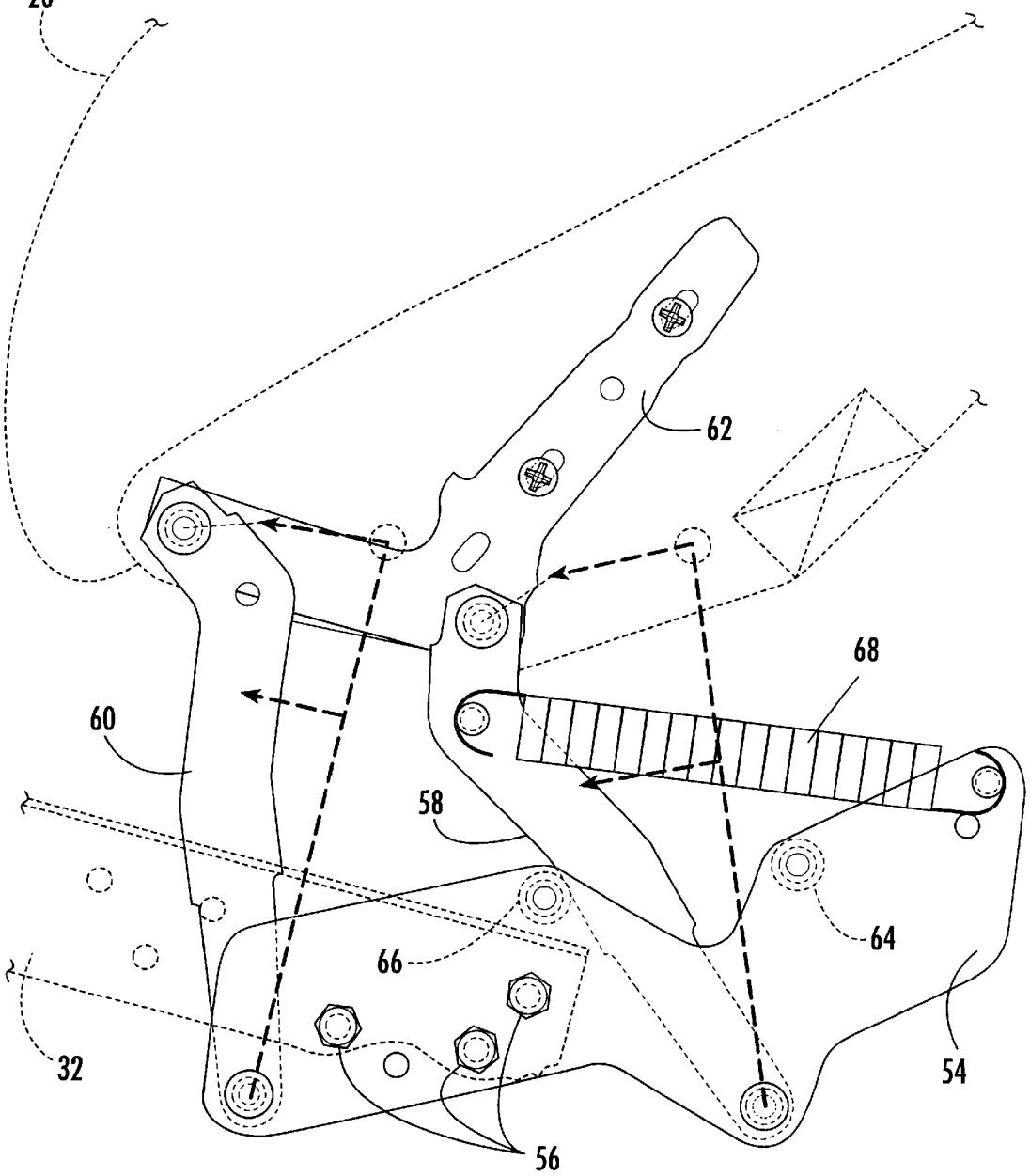

As may best be seen with reference to FIGS. 5–7, the seat back recliner mechanism 25 is supported at the rearward end of the seat mounting rail 32. More specifically, the recliner mechanism 25 includes a secondary mounting plate 54 rigidly bolted at 56 to the rearward end of the seat mounting rail 32. A pair of reclining links 58,60 are pivoted at their respective lower ends to the secondary mounting plate 54 at spacings therealong and extend upwardly therefrom, with the respective upper ends of the reclining links 58,60 being pivoted in spaced relation to an L-shaped mounting bracket 62 affixed rigidly to the seat back 20. A pair of stop bumpers 64,66 are affixed to the secondary mounting plate 54 at opposite sides of the rearward reclining link 58 to define forward and rearward limit positions for pivotal movement of the reclining link 58 and a coil extension spring 68 extends from the rearward end of the secondary mounting plate 54 to the upper end of the rearward reclining link 58 to urge the link 58 to pivot into its rearwardmost limit position in abutment with the stop bumper 64. Alternatively, the spring could be connected between the plate 54 and the forward reclining link 60.

Figure 2:
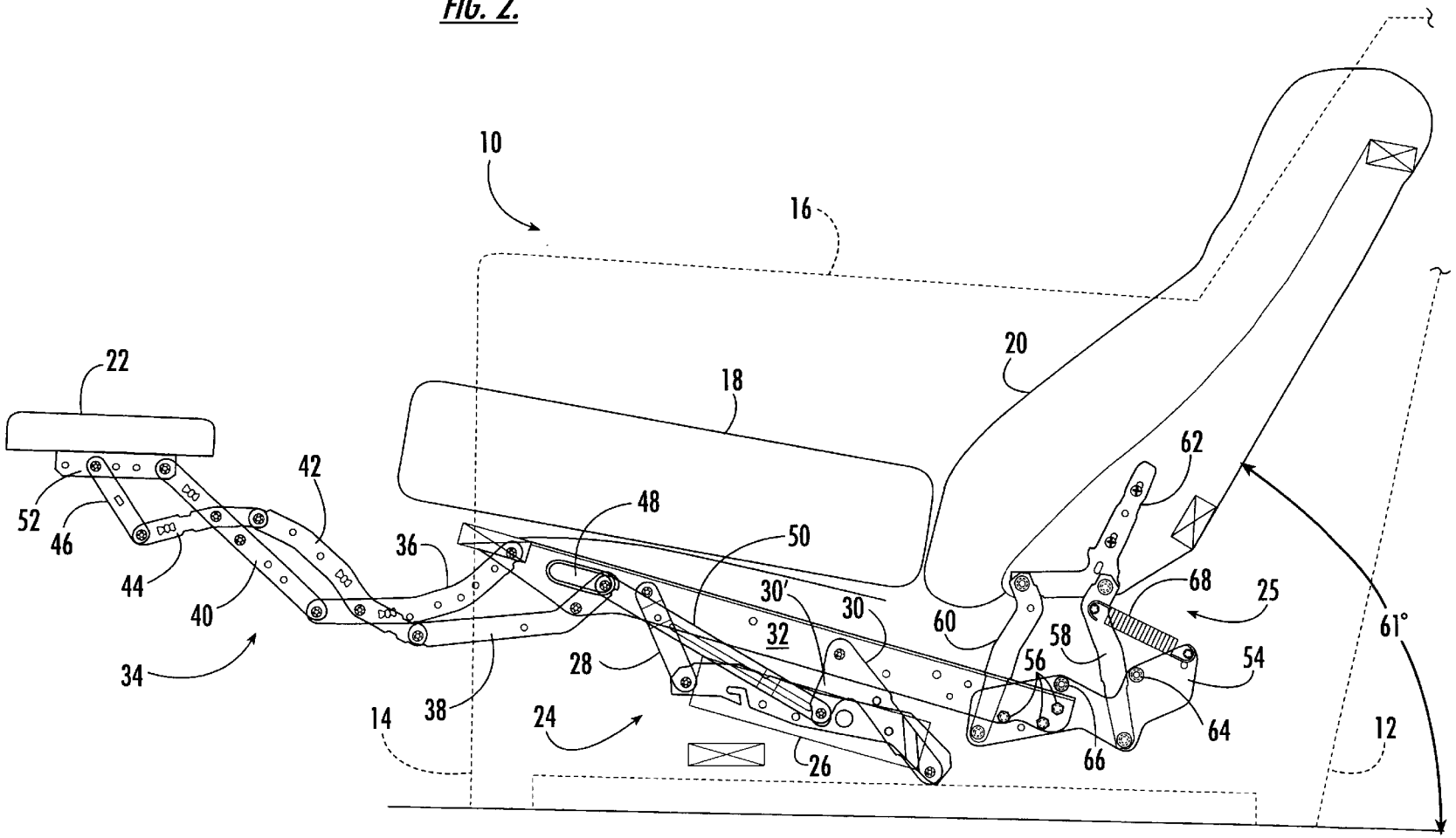

The operation of the recliner chair 10 and, particularly, of the linkage structure 24 and the recliner mechanism 25 may thus be understood. In FIG. 1, the recliner chair 10 is illustrated in its fully upright sitting position, with the linkage structure 24 fully retracted within the chair base 14 between the laterally spaced arm rests 16, wherein the seat mounting rail 32 and the seat 18 are disposed in a generally horizontal disposition with the seat back mounting bracket 62 and the seat back 20 extending in a predominantly upstanding disposition relative to the vertical appropriate for comfortable sitting, e.g., with the seat back disposed at an angle of approximately 69 degrees to horizontal. From the sitting position of FIG. 1, movement of the linkage structure 24 into the TV position of FIG. 2 is accomplished by forward pivoting of the front and rear support links 28,30 with respect to the mounting plate 26. During such movement, the seat mounting rail 32 is translated forwardly relative to the base 14, while shifting the forward end of the rail 32 upwardly and the rearward end of the rail 32 downwardly into a more angled disposition relative to horizontal. At the same time, the forward pivoting movement of the rear support link 30 acts through its crank arm portion 30' to drive the actuating link 50 rearwardly and, in turn, causes the lazy tong linkage assembly 34 to extend forwardly from the base 14, bringing the footrest 22 upwardly into a horizontal disposition disposed forwardly of the seat 18. The described movements slightly incline the seat back 20 into a more angular disposition of about 61 degrees to horizontal, although the disposition of the recliner mechanism 25 remains unchanged relative to the seat mounting rail 32 during this movement of the recliner chair 10 from its full upright position of FIG. 1 to its TV position of FIG. 2, whereby the relationship between the seat 18 and the seat back 20 similarly remains unchanged.

Figure 3:
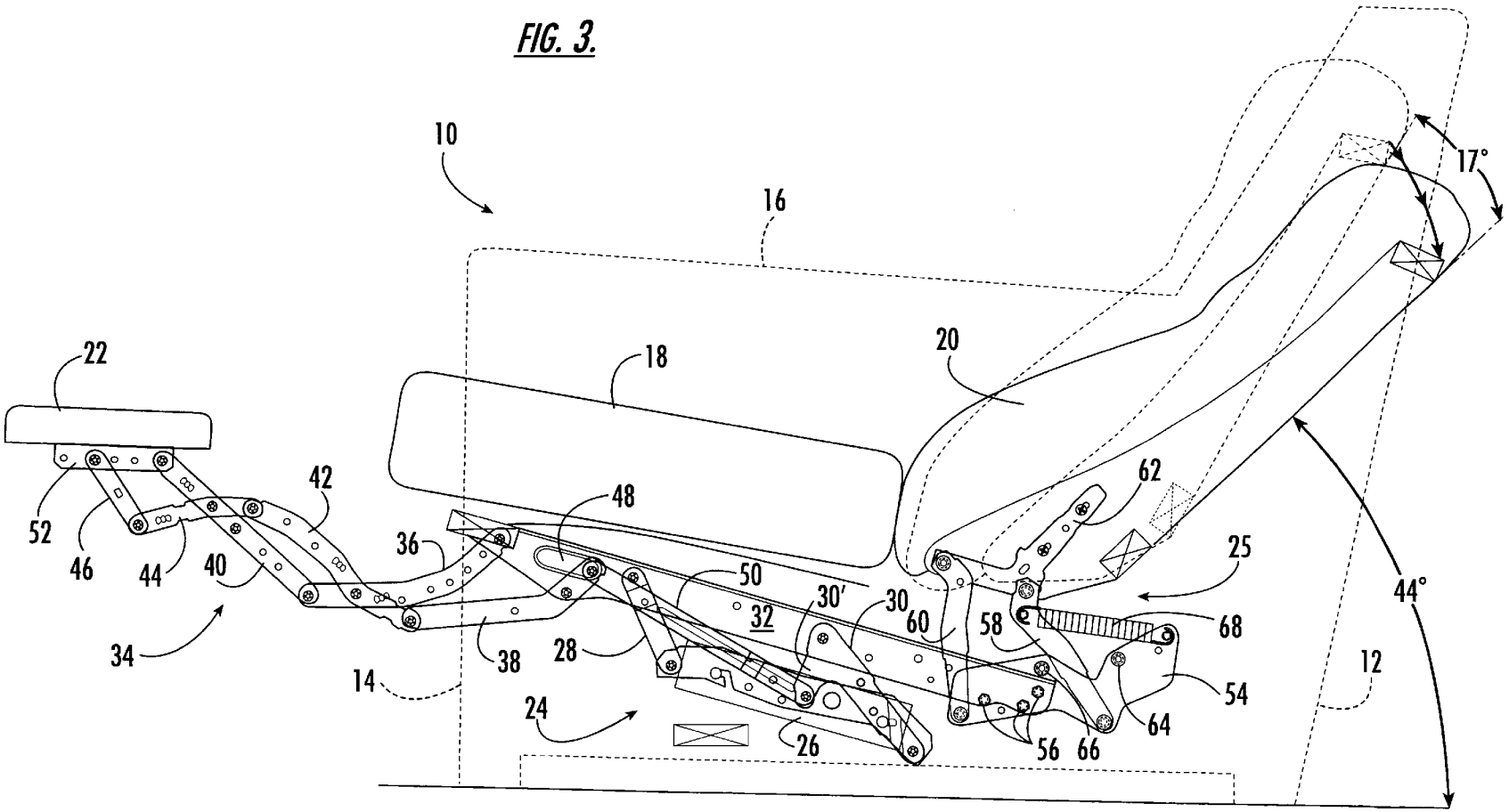

From the TV position of FIG. 2, the recliner chair 10 may be moved further into the fully reclined position of FIG. 3 by a user seated in the chair 10 exerting bodily force rearwardly against the seat back 20, thereby causing the upper ends of the reclining links 58,60 to pivot forwardly against the biasing force of the spring 68 and, in turn, causing the mounting bracket 62 to pivot predominantly about the upper end of the reclining link 58, in an essentially clockwise movement as viewed in FIGS. 1–3, until the rearward reclining link 58 moves into abutment with the forwardmost stop bumper 66, all as depicted in FIG. 3. As a result, the seat back 20 is tilted rearwardly by an angular degree determined by the dispositions of the stop bumpers 64,66, approximately 17 degrees in the embodiment depicted in the accompanying drawings, thereby positioning the seat back at an angle of about 44 degrees to horizontal. During such movements, the disposition of the linkage structure 24 remains unchanged relative to the base 14 of the frame 12.

Figure 4:
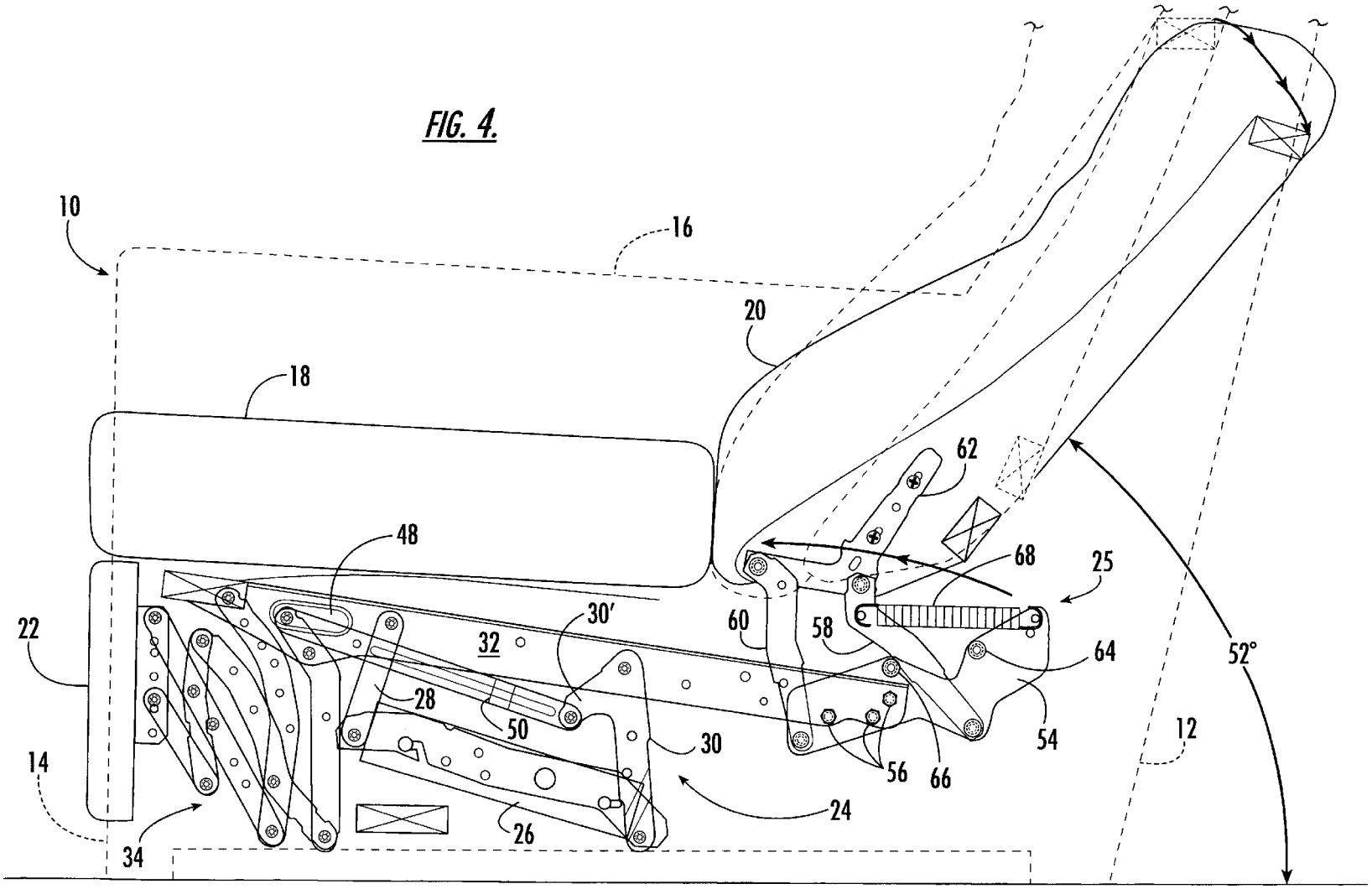

Thus, as will be seen, the recliner mechanism 25 operates entirely independently of the linkage structure 24. Thus, in contrast to conventional recliner chairs, the recliner mechanism 25 of the present invention also uniquely permits the seat back 20 to be similarly reclined from the fully upright sitting position of FIG. 1, without manipulating the linkage structure 24 into the TV position of FIG. 2. Thus, as depicted in FIG. 4, a user seated in the chair 10 in its fully upright sitting position indicated in broken lines can recline the seat back 20 in the same manner described above by exerting a rearwardly directed bodily force against the seat back 20 to pivot the reclining links 58,60 forwardly with respect to the secondary mounting plate 54 against the force of the spring 68, all while the linkage structure 24 remains stationary in its fully retracted condition housed within the base 14 of the frame 12.

As will thus be understood, the unique feature of the present invention in arranging the recliner mechanism 25 to function independently of the linkage structure 24 not only facilitates the incorporation of the recliner mechanism 25 into a traditional recliner chair such as the chair 10, but also uniquely enables the recliner mechanism 25 to be adapted for incorporation into substantially any other form of chair, whether or not the chair incorporates any facility for selective movement of the seat and/or a foot rest such as the linkage structure 24. For example, in a stationary upholstered chair without any such linkage structure 24, the mounting plate 54 could be simply affixed interiorly to the arm rests 16 with the mounting bracket 62 affixed to the seat back of the chair so as to permit selective reclining movement of the seat back 20 relative to the seat which always remains stationary. In view of this independent functionality of the recliner mechanism 25, the possibilities for utilization of the recliner mechanism 25 will be numerous, as will be readily understood by persons skilled in the art. Furthermore, in all such contemplated embodiments, because the recliner linkage 25 provides for a translatory motion by the constituent links 58,60 instead of acting about a fixed pivot point, the linkage 25 also provides the important advantage of avoiding undesirable contact with any nearby wall with minimal spacing from the wall being required.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

I claim:

1. A method for supporting a seat back portion on a framework of a chair for reclining motion independent of a seat portion supported on the chair framework, the seat back portion being mounted by pivotal attachment of a first link only directly to a first support member at a fixed location thereon and to a first side of the seat back portion at a fixed location thereon, pivotal attachment of a second link only directly to a second support member at a fixed location thereon and to the first side of the seat back portion at a fixed location thereon, pivotal attachment of a third link only directly to a third support member at a fixed location thereon and to a second side of the seat back portion at a fixed location thereon, the third link being aligned with the first link for identical movement therewith, and pivotal attachment of a fourth link only directly to a fourth support member at a fixed location thereon and to the second side of the seat back portion at a fixed location thereon, the fourth link being aligned with the second link for identical movement therewith, the first, second, third and fourth support members each being supported on the chair framework and fixed against movement relative to the seat portion, the steps comprising:

arranging the pivotal attachment locations of the links such that, as the seat back portion moves from a first position into a second position, a bottom portion of the seat back portion continually moves toward the seat portion while a rear of the bottom portion continually moves downward relative to the seat portion, and limiting the range of movement of the seat back portion to between the first and second positions.

2. The method of claim 1, wherein a front of said bottom portion moves upwardly during movement of the seat back portion from the first position to the second position.

3. The method of claim 1, wherein said arranged attachment locations include the attachment locations of the first and second links defining the corners of a quadrilateral, a first side thereof extending between the two attachment locations of the first link and an opposed second side thereof extending between the attachment locations of the second link being nonparallel in every position of the quadrilateral throughout said limited movement of the seat back portion.

4. The method of claim 1, wherein said step of limiting the range of movement of the seat back portion comprises disposing bumpers within the path of movement of the links for blocking further movement therebeyond.

5. The method of claim 4, wherein two bumpers are disposed in the path of movement of the first link on opposite sides thereof and two bumpers are disposed in the path of movement of the third link on opposite sides thereof.

6. The method of claim 1, wherein the first and second support members comprise a mounting plate secured in fixed disposition to a seat mounting rail.

7. The method of claim 6, wherein the seat mounting rail is supported on the framework of the chair by a pair of links pivotally attached to both the seat mounting rail and the framework and extending therebetween.

8. The method of claim 6, wherein the seat mounting rail and the mounting member extend underneath the bottom portion of the seat back portion and the links extend upwardly therefrom to the seat back portion throughout said limited movement of the seat back portion.

9. The method of claim 1, further comprising the step of biasing the seat back portion into the first position.

10. The method of claim 9, wherein said step of biasing the seat back portion into the first position comprises securing a spring to and between the first link and the first support member.

11. A chair, comprising:

(a) a seat back portion supported on a framework of the chair for reclining motion independent of a seat portion supported on the chair framework, said seat back portion being mounted by, (i) a first link pivotally attached only directly to a first support member at a fixed location thereon and to a first side of said seat back portion at a fixed location thereon, (ii) a second link pivotally attached only directly to a second support member at a fixed location thereon and to said first side of said seat back portion at a fixed location thereon, (iii) a third link pivotally attached only directly to a third support member at a fixed location thereon and to a second side of said seat back portion at a fixed location thereon, said third link being aligned with said first link for identical movement therewith, and (iv) a fourth link pivotally attached only directly to a fourth support member at a fixed location thereon and to said second side of the seat back portion at a fixed location thereon, said fourth link being aligned with said second link for identical movement therewith, said first, second, third and fourth support members each being supported on said chair framework and fixed against movement relative to said seat portion, said pivotal attachment locations of said links being arranged such that, as said seat back portion moves from a first position into a second position, a bottom portion of said seat back portion continually moves toward said seat portion while a rear of said bottom portion continually moves downward relative to said seat portion; and (b) stop members supported by said chair framework and disposed within a path of travel of said links for abutment therewith to define a limited range of movement of said links such that said links abut said stop members when said seat back portion is disposed in said first and second positions.

12. The chair of claim 11, wherein a front of said bottom portion moves upwardly during movement of said seat back portion from said first position to said second position.

13. The chair of claim 11, wherein said arrangement of attachment locations includes said attachment locations of said first and second links defining the corners of a quadrilateral, a first side thereof extending between said two attachment locations of said first link and an opposed second side thereof extending between said attachment locations of said second link being nonparallel in every position of said quadrilateral throughout the limited movement of said seat back portion.

14. The chair of claim 11, wherein said stop members comprise bumpers disposed within the path of movement of said links for blocking further movement therebeyond.

15. The chair of claim 11, wherein said stop members comprise two bumpers disposed in the path of movement of said first link on opposite sides thereof and two bumpers disposed in a path of movement of the third link on opposite sides thereof.

16. The chair of claim 11, wherein said seat back portion includes an end thereof that abuts said seat portion in both said first and second positions and all positions therebetween within the limited range of movement of said seat back portion.

17. The chair of claim 11, wherein said first and second support members comprise a mounting plate secured in fixed disposition to a seat mounting rail.

18. The chair of claim 17, wherein said seat mounting rail and said mounting member extend underneath said bottom portion of said seat back portion and said first and second links extend upwardly therefrom to said seat back portion throughout the limited movement of said seat back portion.

19. The chair of claim 17, wherein said seat mounting rail is supported on said chair framework by a pair of links pivotally attached to and extending between both said seat mounting rail and said framework.

20. The chair of claim 17, further including a spring disposed between and connected to said first link and said mounting plate for biasing of said seat back portion toward said first position.

* * * * *